US005099279A

United States Patent [19]

Shimizu

[11] Patent Number: 5,099,279

[45] Date of Patent: Mar. 24, 1992

[54] IMAGE FORMING METHOD AND IMAGE FORMING APPARATUS IN WHICH THE DENSITY OF THE TONER IMAGE IS MEASURED AND CONTROLLED

[75] Inventor: Tadafumi Shimizu, Toyokawa, Japan

[73] Assignee: Minolta Camera Kabushiki Kaisha, Osaka, Japan

[21] Appl. No.: 564,402

[22] Filed: Aug. 8, 1990

[30] Foreign Application Priority Data

Aug. 10, 1989 [JP] Japan ..... 1-209252
Aug. 10, 1989 [JP] Japan ..... 1-209253

[51] Int. Cl.[5] ..... G03G 15/00
[52] U.S. Cl. ..... 355/208; 355/246
[58] Field of Search ..... 355/203, 208, 246, 214, 355/216, 228; 118/665

[56] References Cited

U.S. PATENT DOCUMENTS 4,179,213 12/1979 Queener ..... 355/208
4,313,671 2/1982 Kuru ..... 355/214
4,970,536 11/1990 Haneda et al. ..... 355/246 X
4,982,232 1/1991 Naito ..... 355/208

FOREIGN PATENT DOCUMENTS 62-163064 7/1987 Japan ..... 355/203
63-309978 12/1988 Japan .

*Primary Examiner*—Joan H. Pendegrass
*Attorney, Agent, or Firm*—Burns, Doane, Swecker & Mathis

[57] ABSTRACT

An image forming method and an image forming apparatus whereby the density of a toner image of a reference pattern hvaing a predetermined density is measured, based on which image forming conditions are controlled. The image forming conditions is at least one of the quantity of exposure light given to a document, the charging amount with which a photosensitive body is charged and the voltage applied to a developing device. The toner image is formed only at an optional point set in a direction of a rotary shaft of the photosensitive body for measuring the density. Therefore, a waste of toners can be prevented. Moreover, since the density of the toner image formed at the optional point in the direction of the rotary shaft of the photosensitive body is measured, correction of the density can be carried out at the optional point.

20 Claims, 16 Drawing Sheets

IMAGE FORMING METHOD AND IMAGE FORMING APPARATUS IN WHICH THE DENSITY OF THE TONER IMAGE IS MEASURED AND CONTROLLED

BACKGROUND OF THE INVENTION

1. Field of the Invention

This invention relates to an image forming method and an image forming apparatus intended to prevent deterioration of an image resulting from various kinds of ills and failures in the image forming process.

2. Description of Related Art

In a long-time use of a copying machine, such inconveniences may come to appear that a photosensitive body is charged not properly or an adequate exposure cannot be obtained. This is because of the contamination of an electrostatic wire, an electrostatic grid or the like of an electrostatic charger, or the surface deterioration of the electrostatic wire or unevenness of characteristics of the photosensitive body, and also the deterioration of an exposure lamp of an optical system or the contamination of mirrors and lenses, etc. causes the inadequate exposure referred to above. Moreover, these inconveniences undesirably result in a blur of a copied image or a so-called background fog with excessive toners adhered. As such, the assignee of this invention has proposed an apparatus to change the quantity of exposure light (for example, as disclosed in the published specification of Japanese Patent Application Laid-Open No. 63-223762). With this apparatus, a reference latent image is formed on a photosensitive body and then developed into a toner image before a document is copied. Thereafter, the voltage of an exposure lamp is automatically adjusted in response to the measured density of the developed toner image and the density of the document. Incidentally, it is general for the apparatus that a density sensor is fixedly provided, for example, at the center in an elongated direction of a photosensitive drum.

When improper charging or improper exposure occurs in such apparatus as above at the point other than where the density is measured, the copied image cannot have proper density. Because the quantity of exposure light at the point where the improper charging or exposure actually occurs cannot be corrected properly even if the light exposure is arranged to be changed in response to the density of the toner image measured at the fixed measuring point. The copying apparatus of this kind cannot avoid the background fog by itself, thereby requiring an operator to set the quantity of exposure light again properly and to copy again in order to obtain a copy without a background fog. Therefore, the prior art copying apparatus not only gives annoyance to the operator, but wastes copying papers and toners.

In the case where the toner image is formed all over the photosensitive body and the density of the toner image is measured, it does not match an economical viewpoint to consume the toners for the toner image formed at the points other than the measured point.

SUMMARY OF THE INVENTION

One object of this invention is to provide an image forming method and an image forming apparatus whereby the density of an image can be automatically corrected in response to the density distribution of a toner image on a photosensitive body in a direction of a rotary shaft thereof.

A further object of this invention is to provide an image forming method and an image forming apparatus whereby the density of an image can be adjusted without requiring an annoying operation of an operator.

A still object of this invention is to provide an image forming method and an image forming apparatus whereby the density of an image can be adjusted without wasting copying papers and toners.

A still further object of this invention is to provide an image forming method and an image forming apparatus whereby a toner image is formed at an optional position on a photosensitive body in a direction of a rotary shaft thereof and the density of the toner image is measured, thereby preventing a waste of toners.

The procedure for correcting the density of an image in the image forming method according to this invention proceeds as follows. A toner image of a reference pattern with a predetermined density is formed on a photosensitive body, and the density of the toner image is measured at a plurality of points. The measured density of the toner image is judged as to whether it is over a predetermined density. In the case where the measured density exceeds the predetermined density, image forming conditions are changed. Then, a toner image of the reference pattern is formed again only at the points where the density is over the predetermined density, and the density of the toner image is measured again. This sequence of operations is repeated until the measured density becomes not higher than the predetermined density. It is more effective that the maximum value of the density among the density measured at a plurality of points is detected, so that the above-described operation is carried out only to the point corresponding to the maximum value. The image forming conditions mentioned above are the quantity of exposure light given to a document, charging amount of a photosensitive body and a voltage applied to a developing device. It is enough that at least one condition of the three be changed.

The above and further objects and features of the invention will more fully be apparent from the following detailed description with accompanying drawings.

DESCRIPTION OF THE PREFERRED EMBODIMENTS

Figure 1:
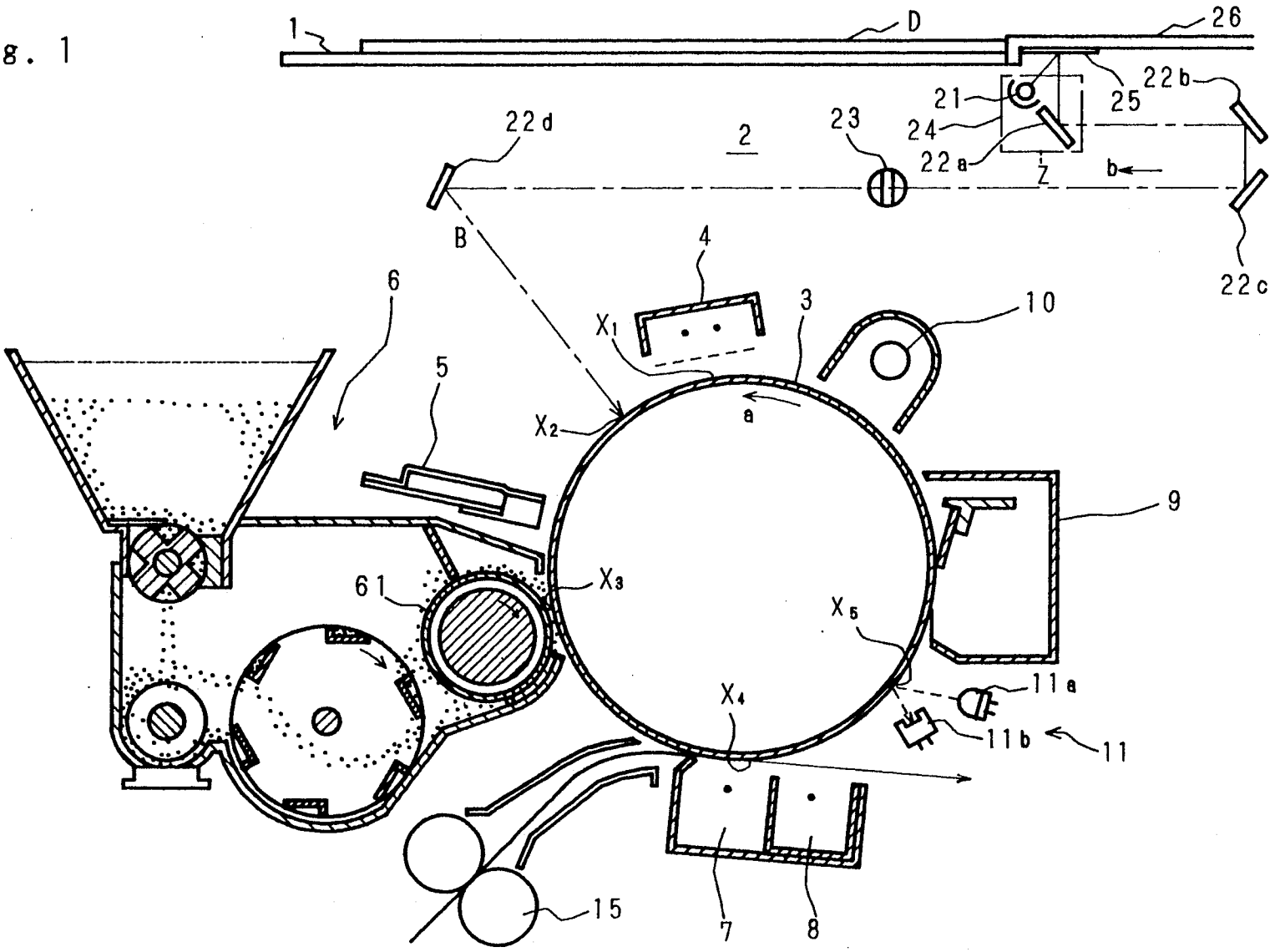
FIG. 1 is a diagram schematically showing the structure of a copying machine embodied by this invention.

Referring first to FIG. 1, a copying machine of this invention is provided with an optical system 2 below a document table glass 1. The optical system 2 includes an exposure unit 24, mirrors 22*b*, 22*c* and 22*d*, a lens 23 and the like. The exposure unit 24 has an exposure lamp 21 which extends in a depthwise direction of the document table glass 1, and a mirror 22*a*. In copying operation, the exposure unit 24 scans a document D while it moves in a direction shown by an arrow b orthogonal to the depthwise direction of the document table glass 1. A reflected light of the document D illuminated by the exposure lamp 21 is reflected by the mirror 22*a* and sent to a direction opposite to the b direction, then reflected again to the same direction as the b direction by the mirror 22*b* and 22*c*, reaching the mirror 22*d* via the condensing lens 23. The light is further reflected by the mirror 22*d* and arrives at a photosensitive drum 3, where an image is formed. When the density of a toner image is to be measured, the exposure unit 24 is moved and stopped below an upper covering 26 placed in the lateral side of the document table glass 1. At this stop position Z, the exposure unit 24 exposes a seal 25 attached to the lower surface of the upper covering 26. The seal 25 is a gray-colored half-tone test chart for forming a toner image.

Figure 2:
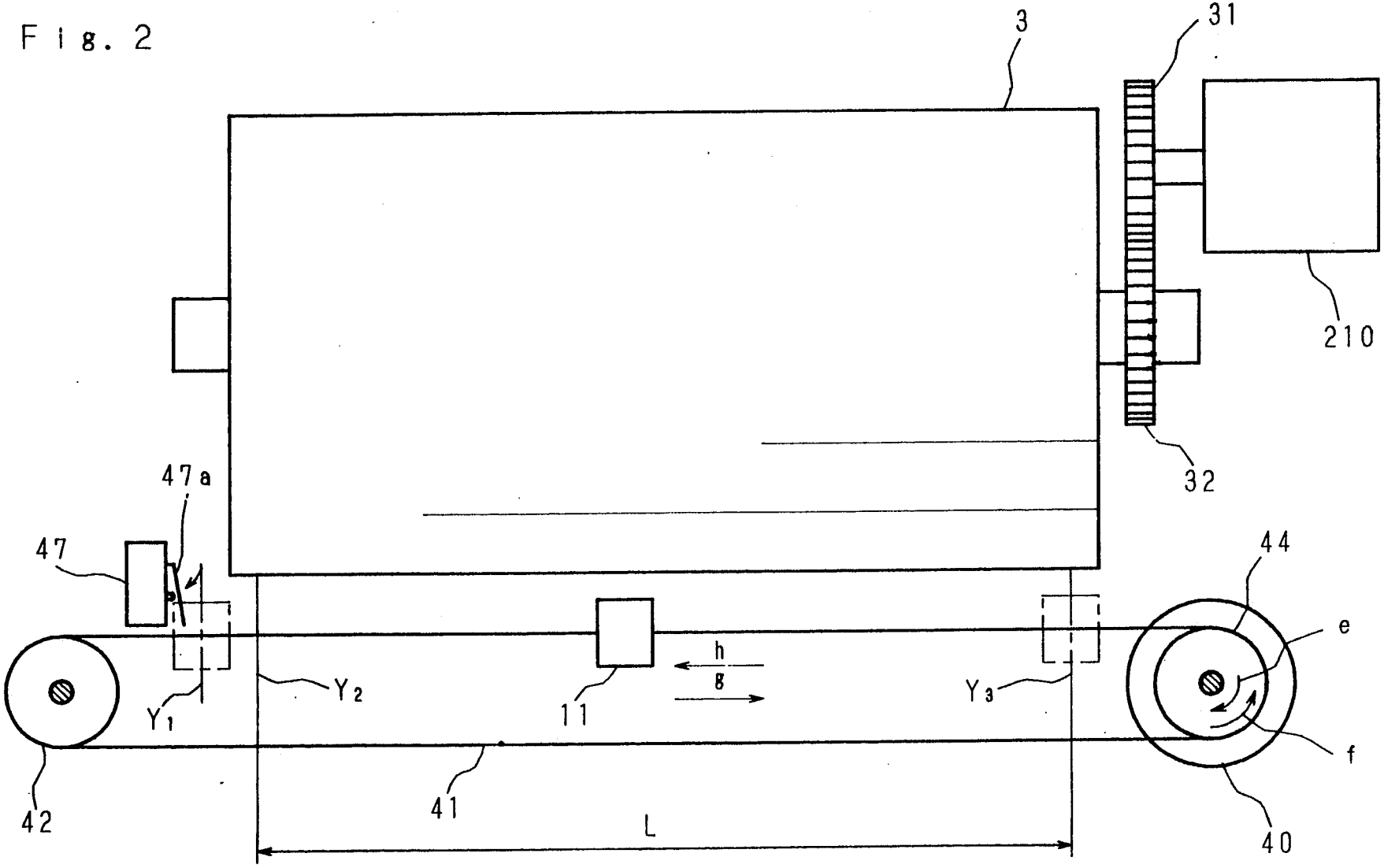
FIG. 2 is a diagram showing the structure and mounting state of a density sensor.

An electrostatic charger 4 is provided below the optical system 2, which uniformly charges an area $X_1$ on the photosensitive drum 3 confronting thereto. As shown in FIG. 2, the driving force of a main motor 210 is transmitted to the photosensitive drum 3 via gears 31 and 32, so that the photosensitive drum 3 is rotated in a direction shown by an arrow a in synchronous manner with the movement of the exposure unit 24 in the b direction. The reflected light of the document D is, through an optical path B, led to an exposure area $X_2$ formed by the optical system 2 on the photosensitive drum 3 downstream of the area $X_1$ in the rotating direction of the drum. Accordingly, an electrostatic latent image corresponding to an image of the document is formed. The unnecessary intermediate electric charge, namely, the electric charge between the image being copied at present and the image to be copied next time is erased by an intermediate eraser 5 composed of an array of LEDs. The electrostatic latent image is supplied with toners at a developing area $X_3$ facing a developing device 6 to be made visible, so that a toner image, a reproduction of the image of the document, is formed.

A copying paper is transferred by a pair of timing rollers 15 to a transfer area $X_4$ facing a transfer charger 7. This transfer of the copying paper is synchronized with the movement of a toner image formed on the photosensitive drum 3 concurrent with the rotation of the photosensitive drum 3. Thus, the toner image is transferred onto the copying paper. The copying paper, after being detached from the photosensitive drum 3 by a separation charger 8, is transferred to a fixing unit (not shown). In the fixing unit, the toner image is melted and fixed onto the copying paper. After the transfer of the toner image, the residual toners on the photosensitive drum 3 are scraped by a cleaning device 9 and moreover the residual electric charge thereon is erased by an eraser lamp 10 through radiation of light.

Hereinafter, a mechanism for measuring the density of the toner image will be described. A density sensor 11 is placed confronting to an area $X_5$ between the transfer area $X_4$ on the photosensitive drum 3 and an area where the cleaning device 9 is provided. The density sensor 11 is a photosensor of reflex type comprised of a light-emitting element 11*a* an a light-receiving element 11*b*. When the exposure unit 24 is stopped at the position Z to expose the seal 25, an electrostatic latent image corresponding to a half-tone image of the seal 25 is formed in the exposure area $X_2$ on the photosensitive drum 3. The electrostatic latent image is developed at the developing area $X_3$ by the developing device 6, whereby a toner image to be measured is formed. This toner image is sent from the developing area $X_3$ to the area $X_5$, without transferring the copying paper and driving the transfer charger 7 and separation charger 8 as in a general copying process. The density of a toner image is measured at the area $X_5$ by the density sensor 11. In the rear and front of the copying machine from opposite ends of the photosensitive drum 3 are provided a driving pulley 44 and a following pulley 42, respectively. The pulleys 44 and 42 are driven by a motor 40 which is rotatable in a normal and a reverse directions. The density sensor 11 is mounted to a wire 41 stretched between the pulleys 44 and 42. The density sensor 11 is moved along a rail (not shown) in an axial direction of the photosensitive drum 3 when the driving pulley 44 is rotated by the motor 40, and measures the density of a toner image at the area $X_5$.

A limit switch 47 is placed in the vicinity of the following pulley 42 so as to set a home position $Y_1$ of the density sensor 11. When the density sensor 11 is found at the home position $Y_1$, a lever 47*a* of the limit switch 47 is pressed, whereby the limit switch 47 outputs a detecting signal $S_p$ to a CPU 201 (with reference to FIG. 3), indicating that the density sensor 11 is at the home position. A pulse generator is incorporated in the motor 40. It generates one pulse signal $P_m$ to the CPU 201 at every predetermined amount of rotation of the motor.

Figure 3:
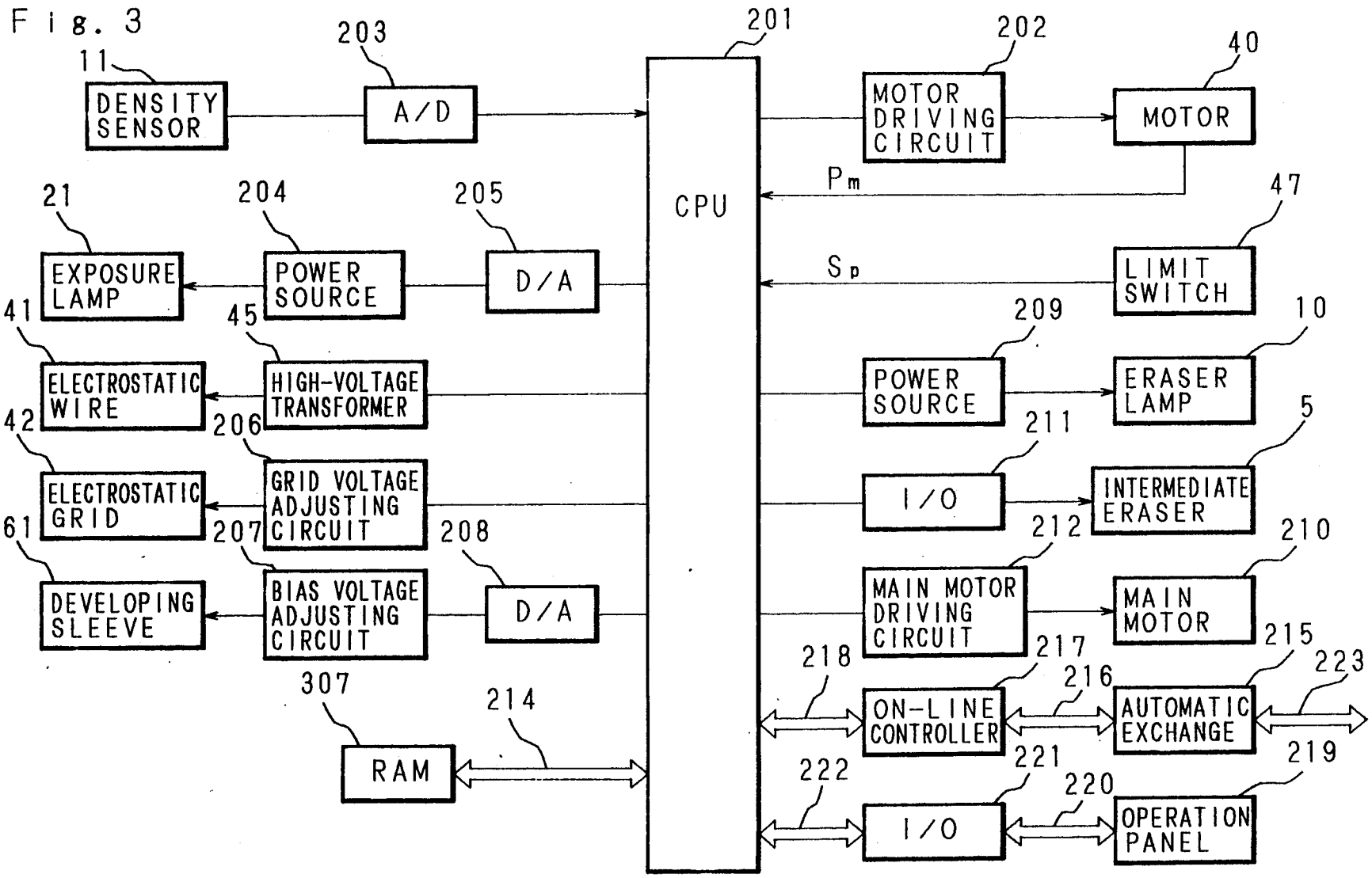
FIG. 3 is a block diagram of a control system.
Figure 4:
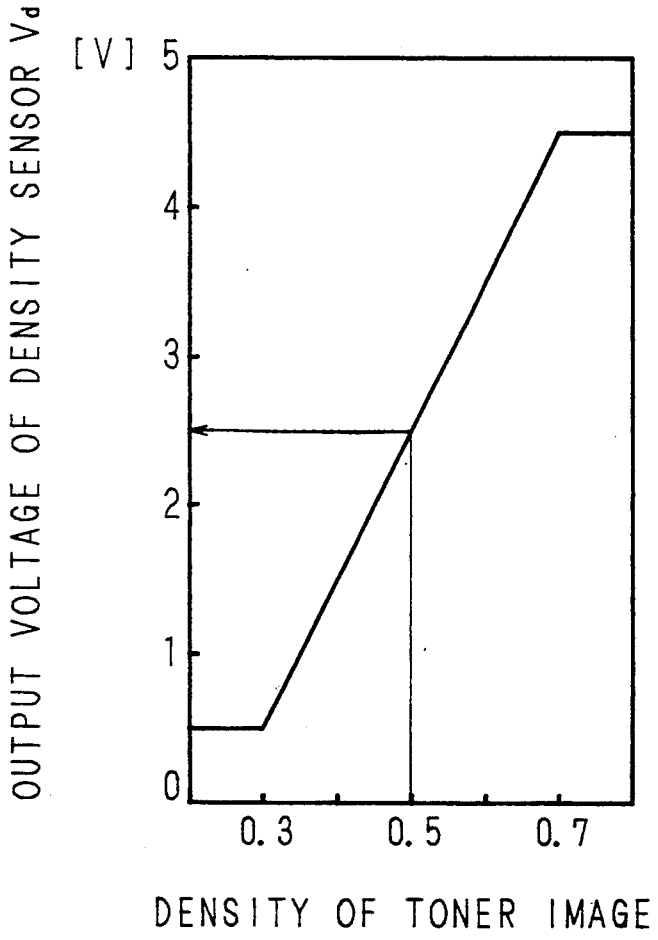
FIG. 4 is a graph showing the relation between the density of a toner image and an output voltage of a density sensor.

Referring now to FIG. 3 showing a block diagram of a control system, the density sensor 11 is connected to an input port of the CPU 201 via an A/D converter 203. An output voltage $V_d$ of the density sensor 11 is converted to digital signals by the A/D converter 203 and inputted to the CPU 201 which controls the copying operation. FIG. 4 is a graph indicating the relation of the density of the toner image measured by the density sensor 11 and the output voltage $V_d$ of the density sensor 11. It is so arranged that the density sensor 11 outputs 2.5 V to an intermediate value 0.5 of the density of the toner image, that is, a half-tone image. The CPU 201 receives the pulse signal $P_m$ generated from the pulse generator of the motor 40 and the home position detecting signal $S_p$ of the limit switch 47, thereby to recognize the position of the density sensor 11. The motor 40 is connected to an output port of the CPU 201 via a motor driving circuit 202. Therefore, the motor 40 is controlled by an output signal from the CPU 201.

Figure 5:
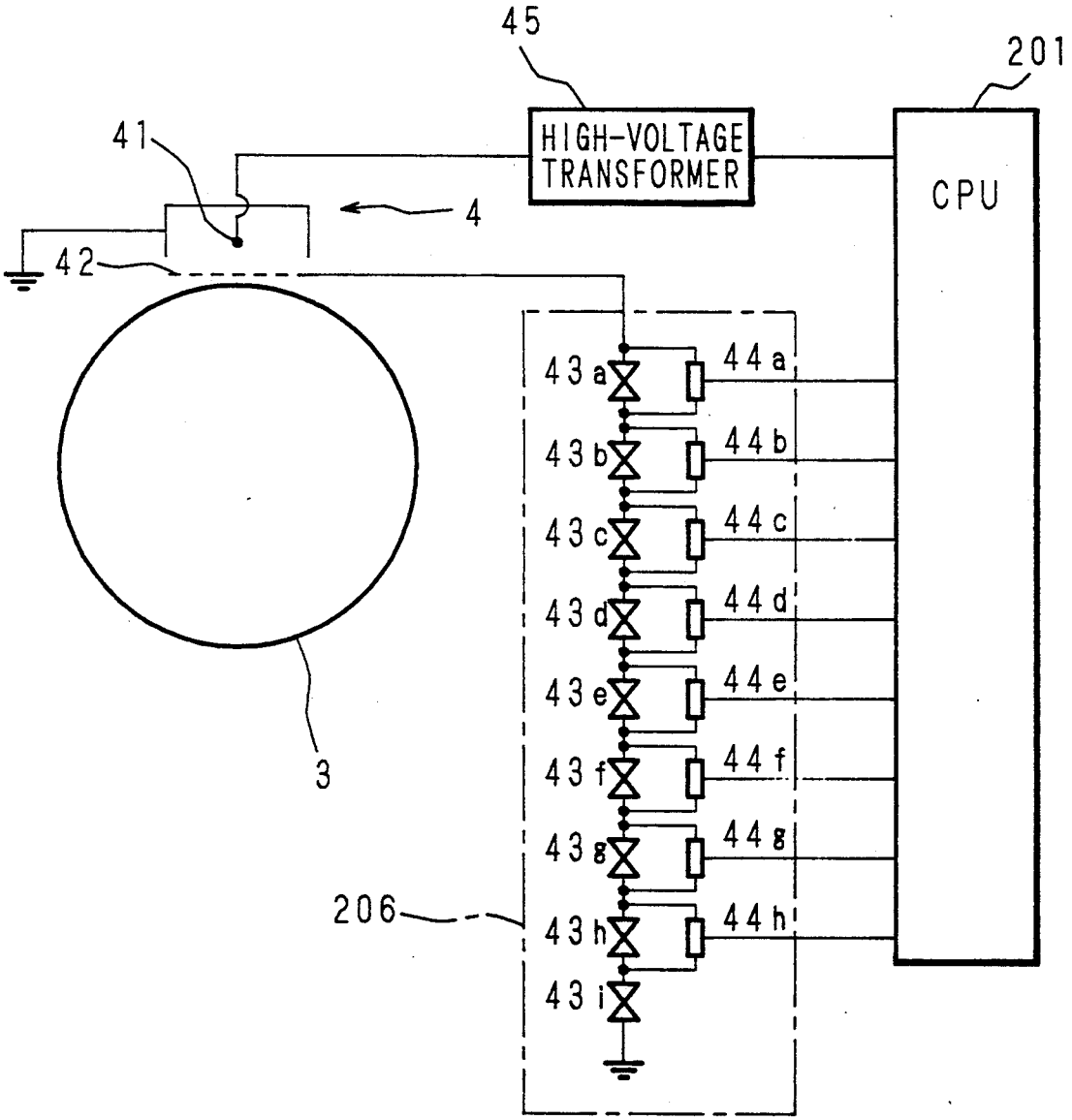
FIG. 5 is a block diagram showing the structure of an electrostatic charger.

To the other output ports of the CPU 201 are connected the exposure lamp 21, electrostatic wire 41 and electrostatic grid 42 of the electrostatic charger 4, a developing sleeve 61 of the developing device 6, eraser lamp 10, intermediate eraser 5 and main motor 210. The exposure lamp 21 is connected to the CPU 201 via a D/A converter 205 and a power source 204. Therefore, the quantity of exposure light is adjusted by a variable setting of a voltage of the power source 204 in correspondence to the output signal of the CPU 201. The electrostatic wire 41 is connected to the CPU 201 via a high-voltage transformer 45, and is applied with a predetermined voltage by the output signal from the CPU 201. The electrostatic grid 42 is connected to the CPU 201 via a grid voltage adjusting circuit 206. In the grid voltage adjusting circuit 206, as shown in FIG. 5, nine varistors 43*a*~43*i* and eight switches 44*a*~44*h* are connected in series between the electrostatic grid 42 and an earth terminal, and moreover, the switches 44*a*~44*h* are respectively connected in parallel to the varistors 43*a*~43*h*. A control signal of 8 bits is outputted from the CPU 201 to the switches 44*a*~44*h*. When the switches 44*a*~44*h* are selectively turned on by the output signal from the CPU 201, the corresponding varistor is short-circuited. The CPU 201 adjusts the grid voltage by selectively turning on the switches 44*a*~44*h* to change the total resistance value of the varistors 43*a*~43*i*, and the charging amount by the electrostatic charger 4 at the area $X_1$ on the photosensitive drum 3 can be adjusted.

Figure 13:
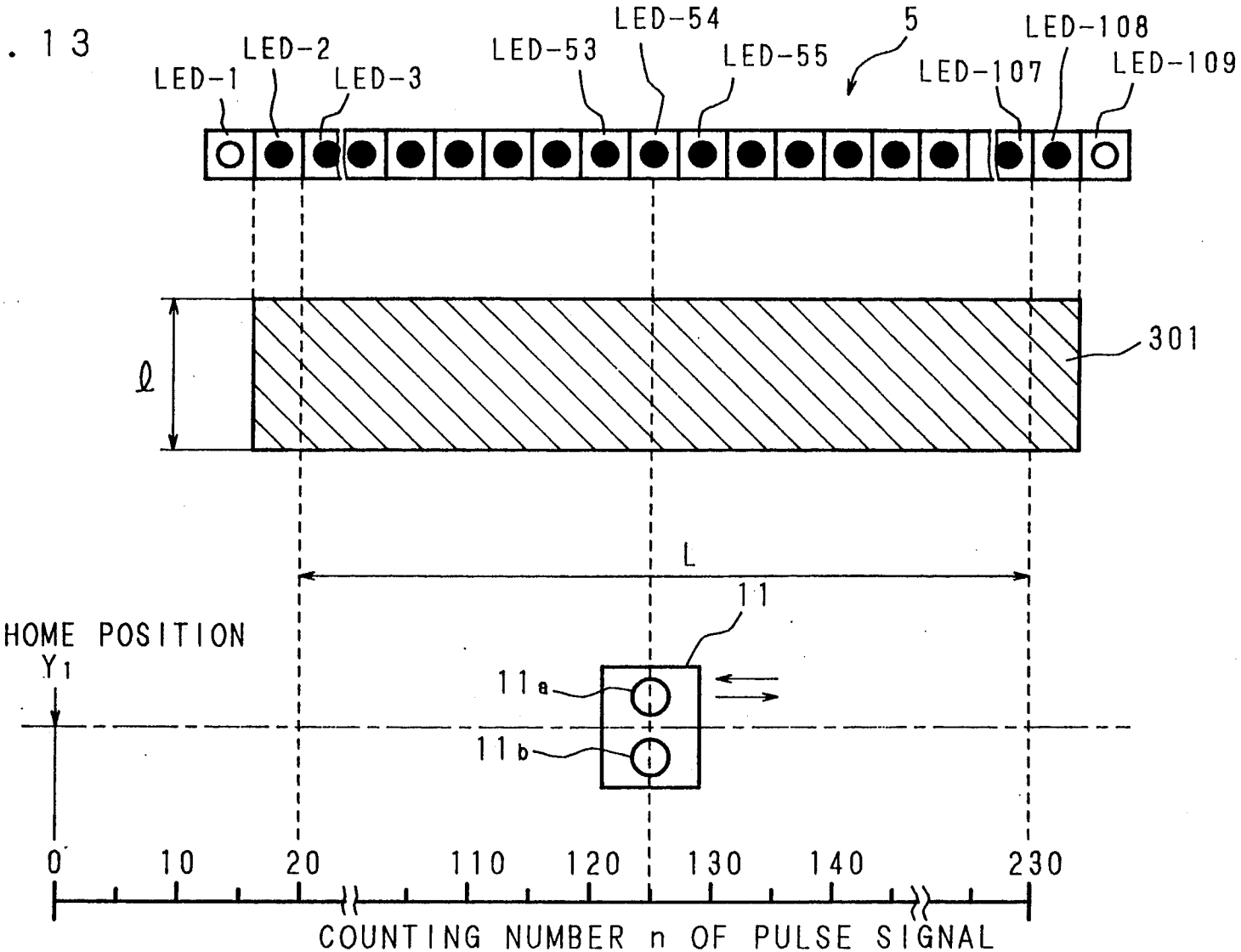
FIG. 13 is a diagram showing the relation among the toner image used in measuring the density, an intermediate eraser and a density sensor.

The developing sleeve 61 is, through a D/A converter 208 and a bias voltage adjusting circuit 207, connected to the CPU 201. A bias voltage applied to the developing sleeve 61 is adjusted in accordance with the output signal of the CPU 201. The eraser lamp 10 which is connected to the CPU 201 through a power source 209 is controlled to be turned on and off by the output signal of the CPU 201. Since the intermediate eraser 5 is connected to the CPU 201 via an I/O interface 211, each LED 1~109 (referring to FIG. 13) comprising of the intermediate eraser 5 is controlled to be turned on and off. Each LED 1~109 are aligned corresponding to an image forming area L of the photosensitive drum 3, and the LED 3~107 are arranged confronting to the image forming area L. If the LED 3~107 are controlled to be selectively turned on or off, the toner image can be formed at a desired area in the image forming area L. The main motor 210 is connected to the CPU 201 through a main motor driving circuit 212. The operation of the main motor 210 is controlled by the output signal of the CPU 201.

On the other hand, the CPU 201 is connected to a RAM 307 via a data bus 214, with writing and reading the data such as the detecting value of the density sensor 11 or the like to the RAM 307. Moreover, the CPU 201 is connected to an operation panel 219 through a data bus 222, an I/O interface 221 and a data bus 220, so that signals are sent and received between the CPU 201 and various key switches and indicators on the operation panel 219. The CPU 201 is further connected to an on-line controller 217 through a data bus 218. The controller 217 is connected via an extension telephone line 216 to an automatic exchange 215, which is also connected to an outside telephone line 223. These are intended to automatically inform conservators at a service station of an abnormal operation of the copying machine.

The operation of the copying machine with the above-described structure will be discussed hereinbelow with reference to flow charts showing the controlling procedure of the CPU 201.

Figure 6:
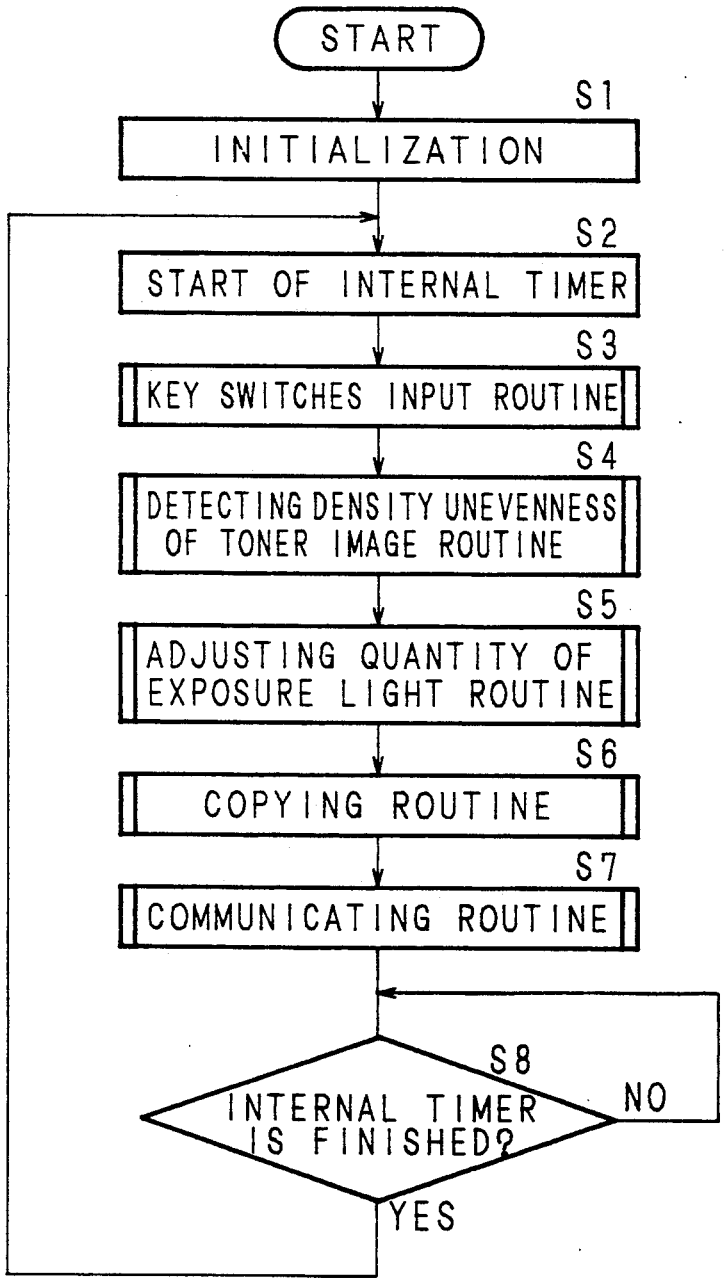
FIGS. 6 through 12 are flow charts showing the controlling procedure of a CPU.

FIG. 6 shows a main routine of the copying machine. When the copying machine is supplied with electric power, the CPU 201 turns itself into an initial state (Step S1). An internal timer is started in Step S2. The internal timer determines a time necessary for one cycle of the main routine irrespective of the contents processed in each subroutine. In Step S3, signals are inputted to key switches and indicators of the operation panel 219. Step S4 wherein the density unevenness of the toner image is detected will be explained later in a detailed manner with reference to FIGS. 7 through 9. When the unevenness is detected, the quantity of exposure light is adjusted to correct the unevenness in Step S5 which is made more clear from FIGS. 10~12.

In succeeding Steps S6 and S7, a copying routine and a communicating routine with the other CPUs (not shown) than the CPU 201 are sequentially called. After completion of the entire sub-routines, the flow is returned from Step S8 to Step S2 after the internal timer is finished. Each timer used in the respective sub-routine does counting in the span of one cycle of the routine. Every timer is judged to be finished by the number of countings of the one cycle of the routine.

Figure 7:
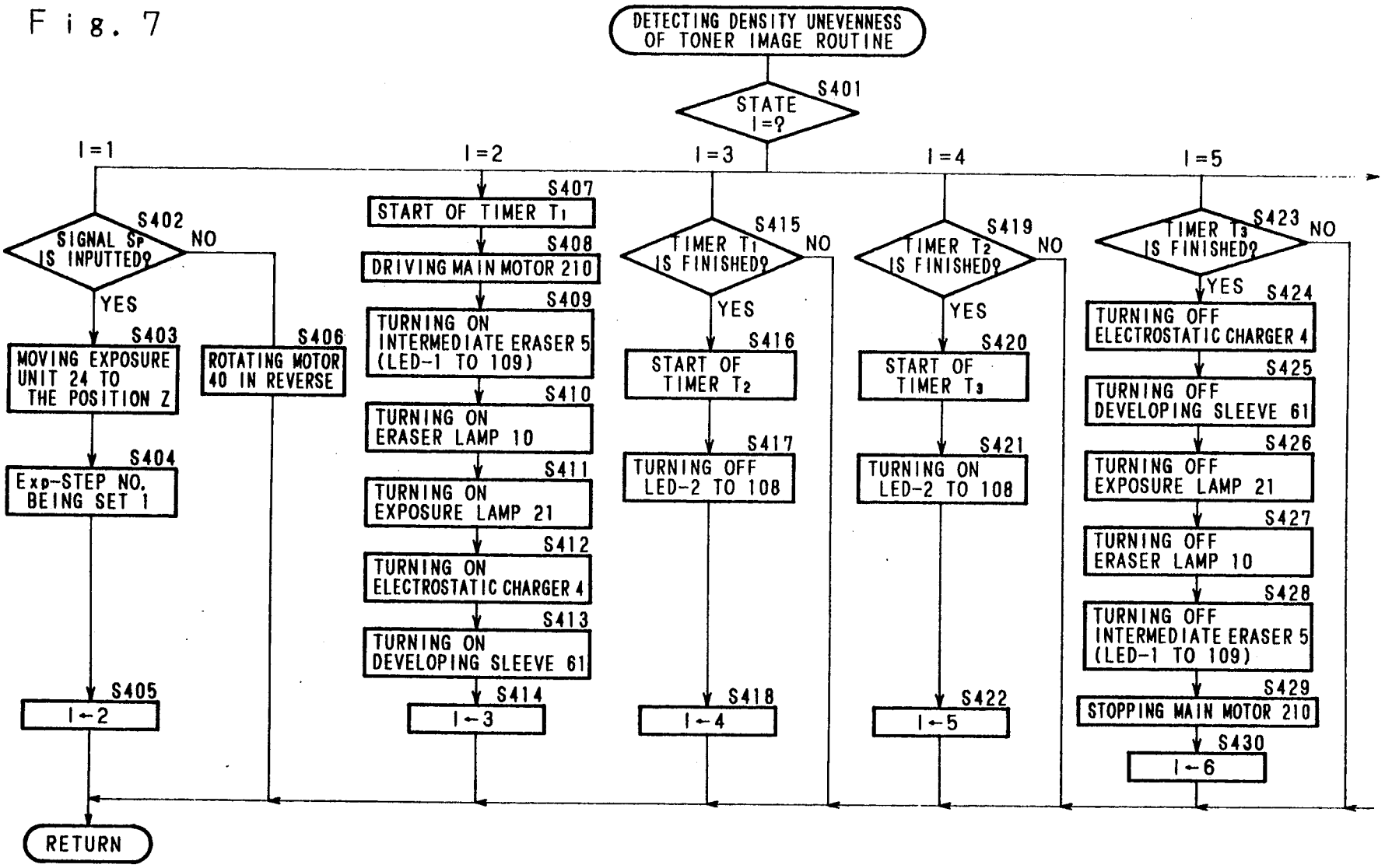
Figure 8:
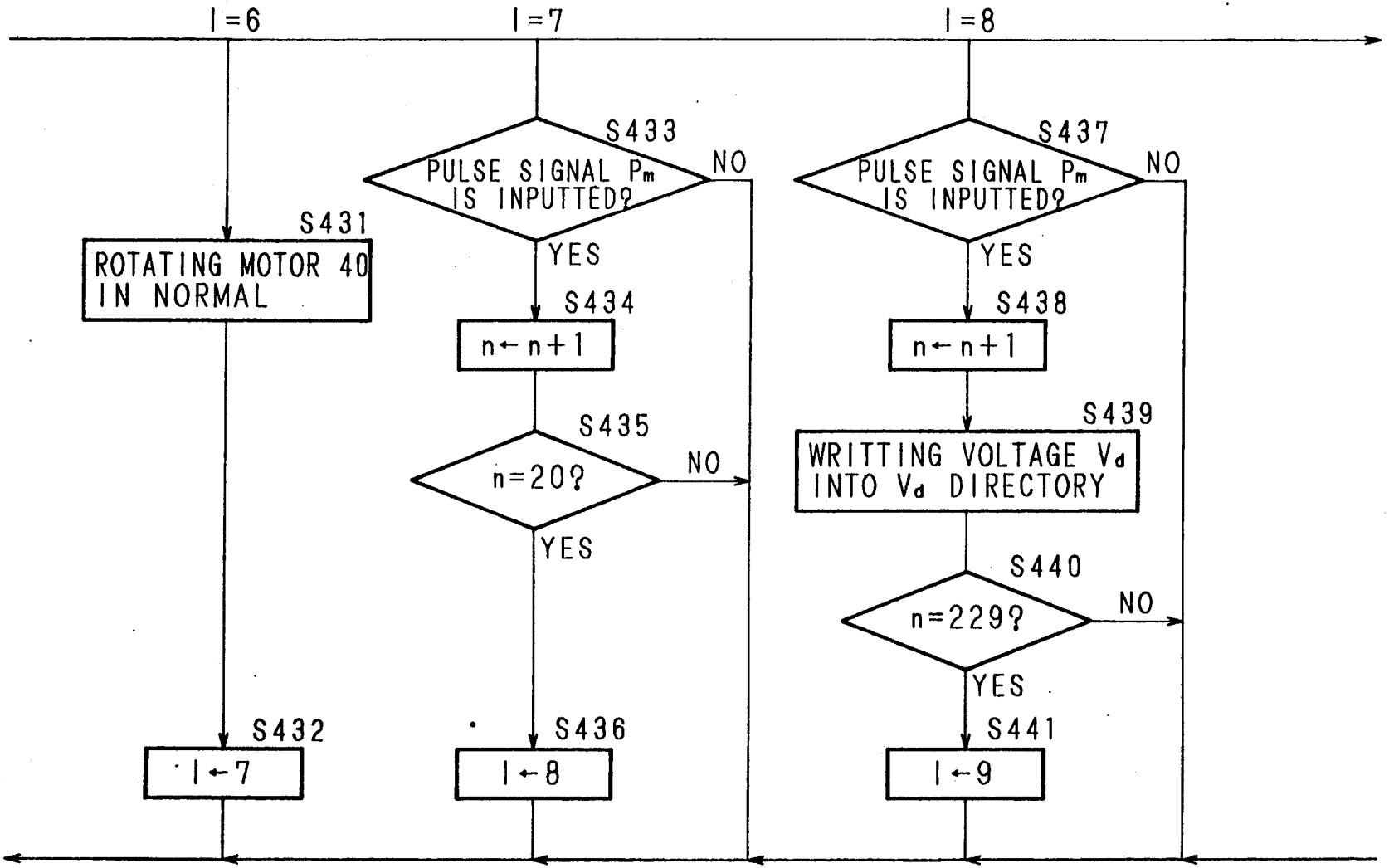
Figure 9:
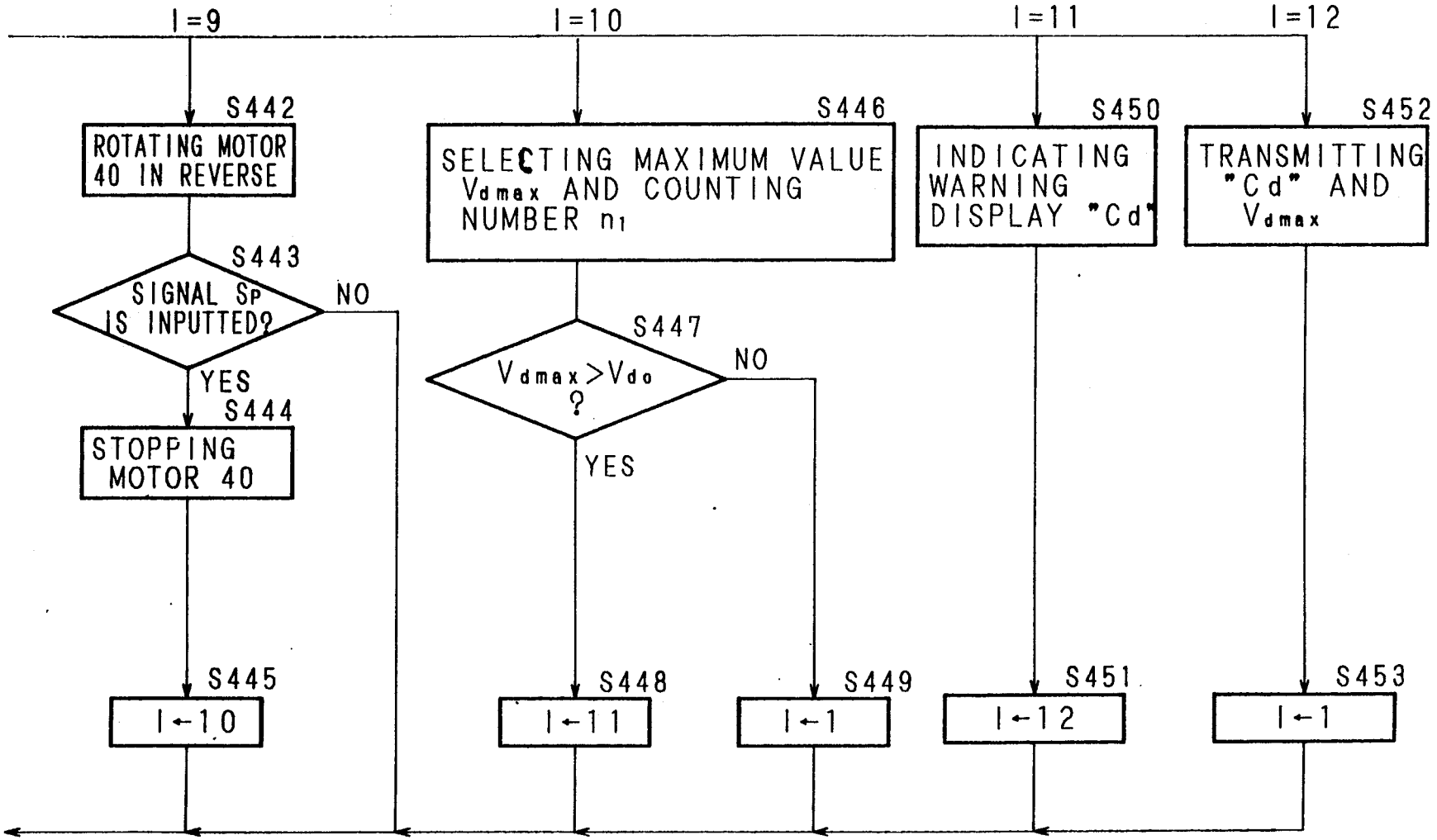

Now with reference to FIGS. 7~9, detection of the unevenness in density of the toner image will be discussed hereinbelow. In Step S401, contents of a register which are set in accordance with the circuit state (hereinafter referred to as a state I) is detected. Since the state I is initially set to be 1, at the start of operation, the flow goes to Step S402 where the state I=1. It is detected in Step S402 whether the detecting signal $S_p$ is inputted, i.e., whether density sensor 11 is at the home position $Y_1$. If the density sensor 11 is not at the home position $Y_1$, a reverse signal is outputted to the motor driving circuit 202, so that the motor 40 is rotated in a reverse direction shown by an arrow f (referring to FIG. 2). Thus, the density sensor 11 is moved in a direction shown by an arrow h to be set at the home position $Y_1$ (Step S406). After the density sensor 11 is set at the home position $Y_1$, the exposure unit 24 of the optical system 2 is moved to the position Z, namely, the position where the seal of a half-tone test chart is exposed (Step S403).

In Step S404, a signal $S_1$, which will be described later, is outputted to the D/A converter 205 to set the output voltage of the power source 204 at 90 V corresponding to a reference quantity of exposure light. Table 1 shows the relation between a signal S, specifically, signals $S_1$~$S_9$ and the output voltage of the power source 204 set corresponding to respective signals.

TABLE 1

| Exp-STEP No. | Signal S | Output Voltage of Power Source 204 (V) |
|---|---|---|
| 1 | $S_1$ | 90 |
| 2 | $S_2$ | 91 |
| 3 | $S_3$ | 92 |
| 4 | $S_4$ | 93 |
| 5 | $S_5$ | 94 |
| 6 | $S_6$ | 95 |
| 7 | $S_7$ | 96 |
| 8 | $S_8$ | 97 |
| 9 | $S_9$ | 98 |

According to the present embodiment, the output voltage of the power source 204 is able to be set in 9 steps with an interval of every 1V from 90 V to 98 V in correspondence to signals $S_1$~$S_9$. The CPU 201 is equipped with a counter which counts numerical values 1~9 respectively corresponding to outputs of signals $S_1$~$S_9$ (referred to as an Exp-STEP No. hereinbelow), and the counting value is renewed in accordance with the change in the Exp-STEP No. The Exp-STEP No. is set to be 1 at the first step S404, and the signal $S_1$ is outputted. The Exp-STEP No. 1 represents a reference quantity of exposure light. The higher the Exp-STEP No. is set, the more is corrected the quantity of exposure light, namely, the amount of light. The output voltage may be adjusted continuously without steps, instead of being changed stepwise as described above.

When the Exp-STEP No. is set to be 1 in Step S404, the flow moves to Step S405 where the state I=2. A timer $T_1$ which counts the time necessary to set each equipment in an operable state to form the toner image is started in Step S407. A signal is outputted to the main motor driving circuit 212 in Step S408, thereby to drive the main motor 210 and rotating the photosensitive drum 3. After the intermediate eraser 5 and eraser lamp 10 are turned on (respectively in Steps S409 and S410), the power source 204 set at 90 V is turned on to light the exposure lamp 21 (Step S411). In Step S412, a signal is outputted to both the high-voltage transformer 45 and grid voltage adjusting circuit 206, thereby to turn on the electrostatic charger 4. In Step S413, a signal is outputted to the bias voltage adjusting circuit 207 to apply a predetermined bias voltage to the developing sleeve 61. It is to be noted here that all of the LED 1~109 of the intermediate eraser 5 are turned on at this time and therefore, the image forming area L is erased in its entirety. Accordingly, an electrostatic latent image corresponding to the half-tone image of the seal 25 is continuously formed at the exposure area $X_2$ on the photosensitive drum 3, and erased at the erasing area of the intermediate eraser 5.

In the state I=3, it is first detected whether the timer $T_1$ completes counting (Step S415). After the timer $T_1$ finishes counting, a timer $T_2$ which limits the time for forming the toner image is started in Step S416. The timer $T_1$ requires, as its counting time, at least the time for the area $X_1$ charged by the electrostatic charger 4 to reach the erasing area of the intermediate eraser 5. In general, however, it is desirable to repeatedly charge and erase the photosensitive drum 3 until the electrostatic characteristic and sensitivity thereof are stabilized. Therefore, the counting time of the timer $T_1$ is suitable to be the time approximately for one rotation of the photosensitive drum 3. When the timer $T_2$ is started, the LED 2~108 of the intermediate eraser 5 are turned off in Step S417. A non-erasing area is formed on the photosensitive drum 3 with a little wider width than the image forming area L. The timer $T_2$ is detected to be completed in Step S419 where the state I=4. Then, a timer $T_3$ is started (Step S420) and the LED 2~108 of the intermediate eraser 5 are turned on (Step S421). The counting time of the timer $T_2$ is set to be the time for the surface of the photosensitive drum 3 to move by a distance l in FIG. 13. When the electrostatic latent image formed at the exposing area $X_2$ on the photosensitive drum 3 passes the developing area $X_3$. toners are supplied to the latent image by the developing sleeve 61, whereby a toner image 301 having a width slightly larger than the image forming area L and a length l is formed on the photosensitive drum 3. Since the time when the intermediate eraser 5 is turned off is restricted by the timer $T_2$, it never happens that the toner image 301 is formed with a longer length than required.

In the state I=5, it is detected in Step S423 whether the timer $T_3$ is up. The counting time of the timer $T_3$ is set to be the time necessary for the toner image 301 to move to the area $X_5$ confronting to the density sensor 11. When the timer $T_3$ is finished counting, the electrostatic charger 4 is turned off in Step S424. Thereafter, supply of the bias developing voltage is cut to sequentially turn off the exposure lamp 21, eraser lamp 10 and all the LEDs of the intermediate lamp 5 (Steps S425~S428). The main motor 210 is stopped, thereby stopping the rotation of the photosensitive drum 3 (Step S429). The toner image 301 is stopped at the position confronting to the density sensor 11. Thus, a preparatory work for measuring the density of the toner image is completed.

In the state I=6, the motor driving circuit 202 is fed with a normal signal, so that the motor 40 is driven in a normal direction indicated by an arrow e (referring to FIG. 2), with the density sensor 11 started to move in a direction shown by an arrow g (Step S431). In the state I=7, it is judged whether the pulse generator in the motor 40 generates a pulse signal $P_m$ (Step S433). When the pulse signal is inputted, a counting value n of the inner counter is incremented by 1 (Step S434). In Step S435, if the pulse signal $P_m$ is counted 20 times, the flow proceeds to Step S436 where the state I=8. the couting value 20 represents the state where the density sensor 11 reaches $Y_2$, a forward end of the image forming area L (referring to FIG. 2).

In Step S437, similar to Step S433, it is detected whether the pulse signal $P_m$ is inputted. If the pulse signal $P_m$ is inputted, the counting number n is added with 1 in Step S438. The output voltage $V_d$ of the density sensor 11 which is converted to digital values by the A/D converter 203 is sequentially written, through the data bus 214, into a predetermined area (referred to as a $V_d$ directory) inside the RAM 307 corresponding to the counting number n (Step S439). It is detected in Step S440 whether the counting number n becomes 229. Measurement of the density of the toner image is finished when the counting value n becomes 229. The flow advances to Step S441 where the state I=9. The counting numbers 21~229 correspond to the total length $Y_2$~$Y_3$ of the image forming area L (referring to FIG. 2). The density $V_d$ of the toner image all over the image forming area L in an elongated direction of the photosensitive drum 3 is thus completely measured.

In the state I=9, the motor 40 is started to be rotated in a reverse direction, so that the density sensor 11 is started to move in a direction shown by an arrow h (Step S442). When the home position detecting signal $S_p$ is inputted in Step S443, the motor 40 is stopped, with the flow moving to Step S444 and S445 where the state I=10.

In the state I=10, the measured value $V_d$ stored in the $V_d$ directory corresponding to the counting number n is read from the RAM 307. The maximum value $V_{dmax}$ among the read data, that is, the measured value of the part of the image with the highest density is selected together with the corresponding counting number $n_1$ (Step S446). It is judged in Step S447 whether the maximum value $V_{dmax}$ is higher than a reference value $V_{d0}$ which is stored in advance in the RAM 307 to recognize an unevenness in density of the toner image. In the event that the $V_{dmax}$ is higher than $V_{d0}$, it means that the density unevenness is observed in the toner image, and the flow goes to Step S448 where the state I=11. On the contrary, when the $V_{dmax}$ is lower than $V_{d0}$, the density unevenness does not occur in the toner image, and the state I is set to be 1. The flow returns to the main routine (Step S449). Although the density unevenness is recognized by the maximum value among the data of the measured density according to the present embodiment, it may be possible to recognize the density unevenness, for example, by the size of the difference between the maximum and minimum values.

A warning display "Cd" indicating that the density of the toner image is improper is indicated at a predetermined display unit of the operation panel 219 in the state I=11 which is followed by the state I=12 (Steps S450 and S451). In the state I=12, an instruction to transmit the data of "Cd" and the maximum value $V_{dmax}$ is sent to the on-line controller 217 (Step S452). In consequence, the data of the abnormal operation is sent to a service station through the telephone line 223. Then, the state I is set to be 1, whereby the flow is returned to the main routine (Step S453).

Figure 10:
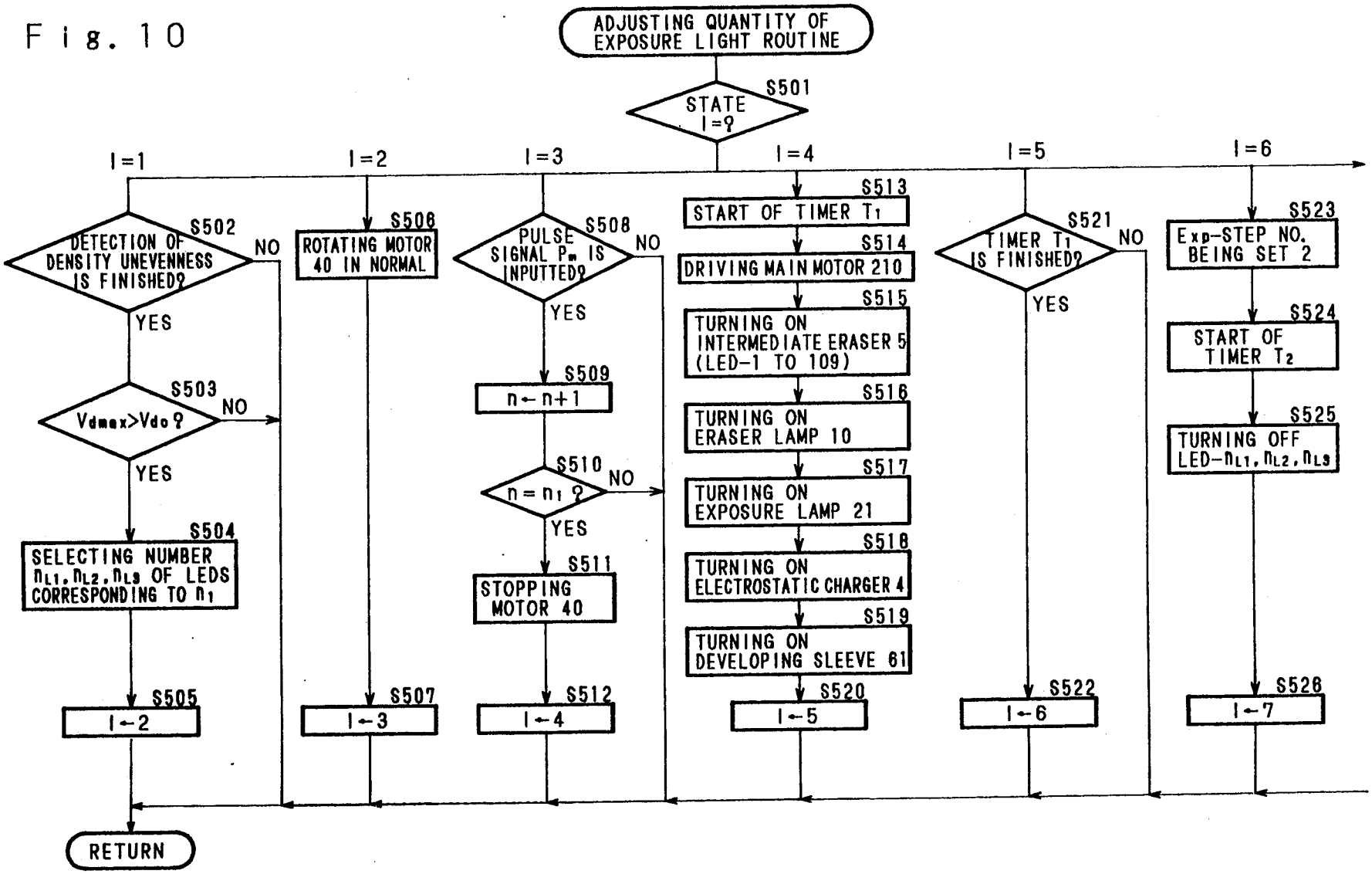
Figure 11:
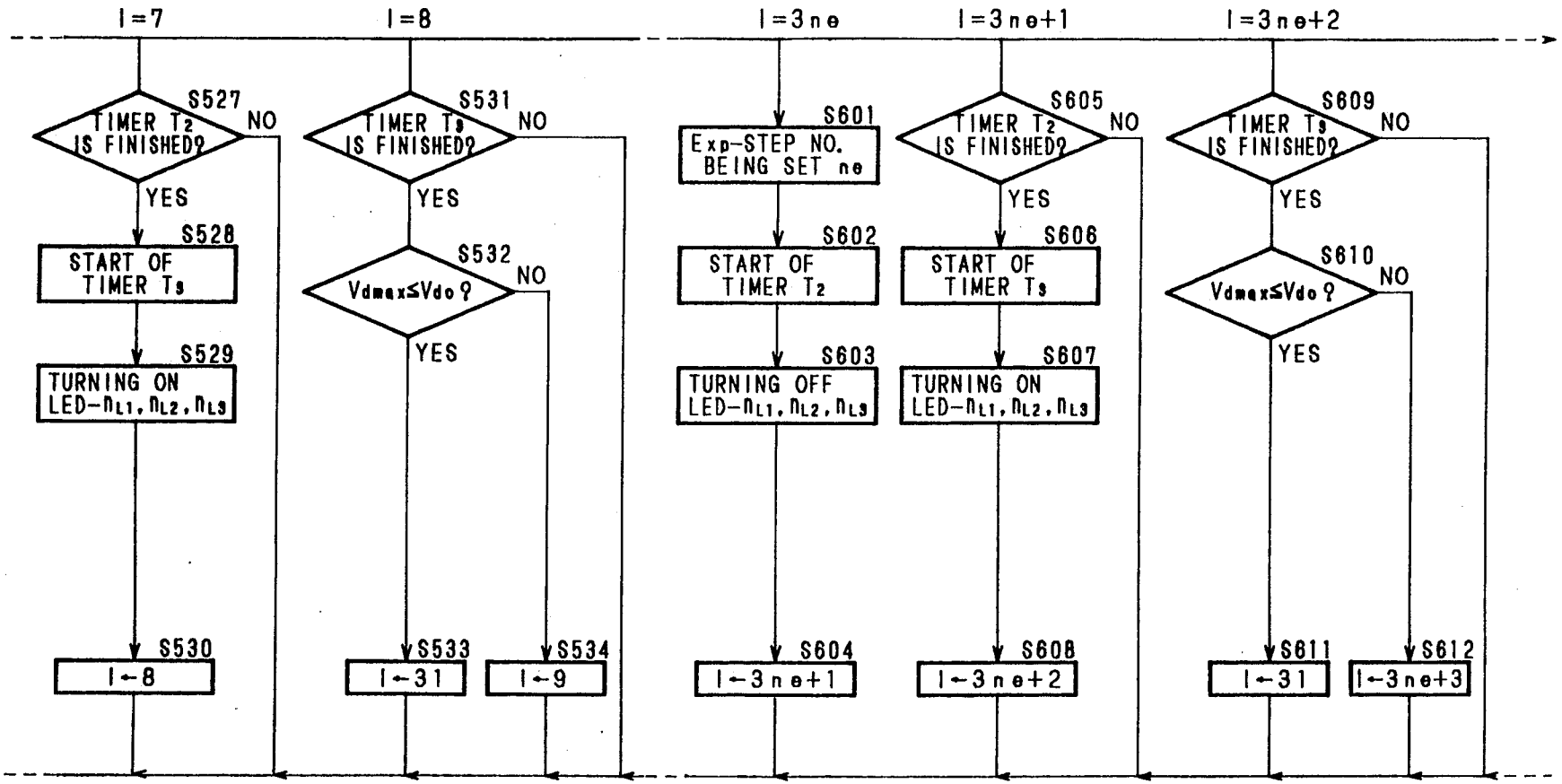
Figure 12:
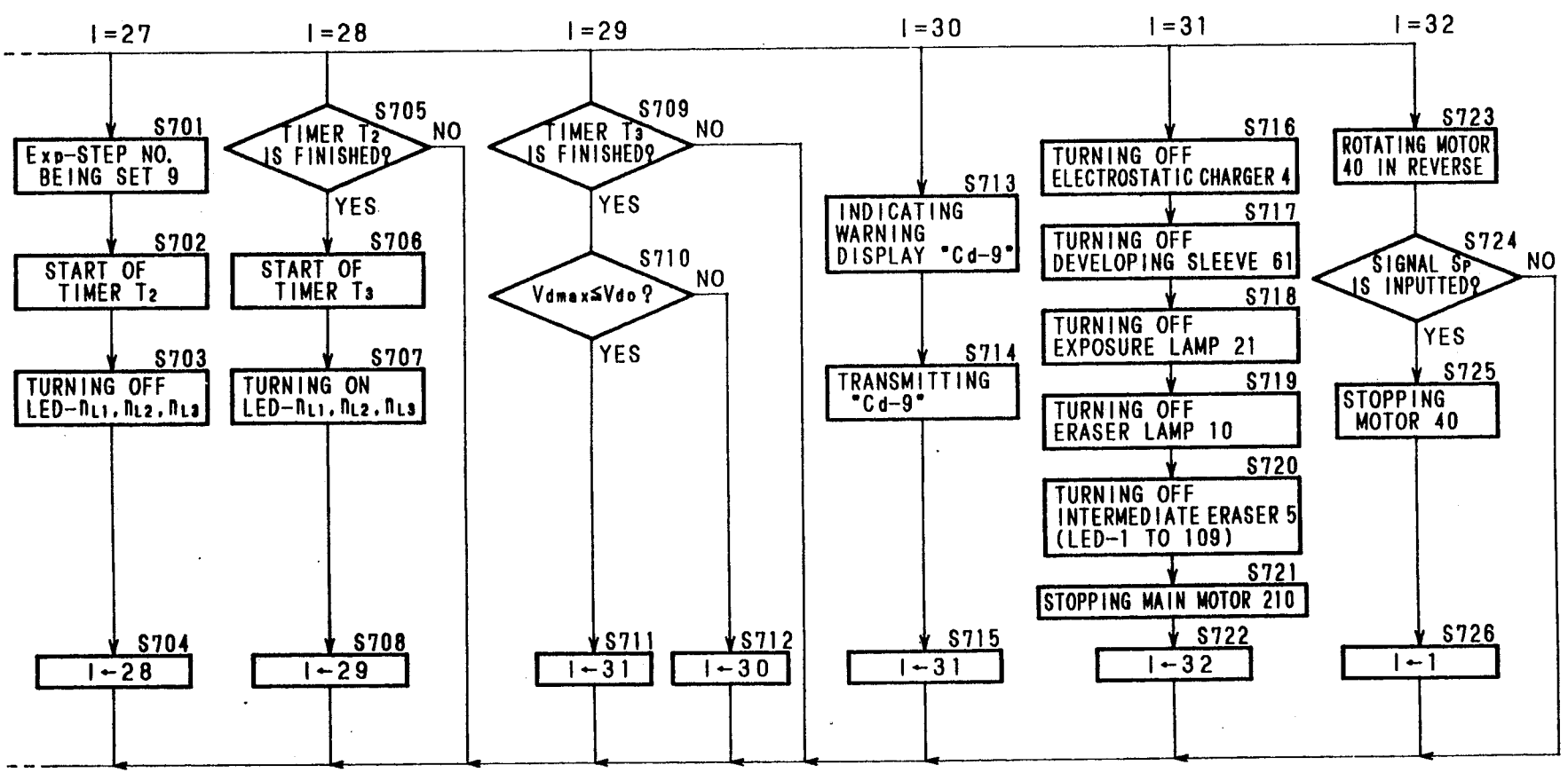

In case of the uneven density observed in the toner image, the quantity of exposure light should be adjusted as follows in accordance with the adjusting routine indicated in FIGS. 10~12. Similar to the detecting routine wherein the density unevenness is detected as discussed hereinabove, the number of the state is detected in Step S501 in the adjusting routine. Since the state is initially set to be 1 also for this sub-routine, it is judged whether detecting of the density unevenness is completely finished in Step S502 where the state I=1. If checking is completed, in Step S503 the density unevenness is detected from the result of comparison between the maximum value $V_{dmax}$ and reference value $V_{d0}$ as discussed hereinabove. Without the density unevenness, the flow returns to the main routine. On the other hand, with the density unevenness detected, the number of the LED of the intermediate eraser 5 corresponding to the counting number $n_1$ at the position where the maximum value $V_{dmax}$ is measured is calculated in Step S504.

Figure 14:
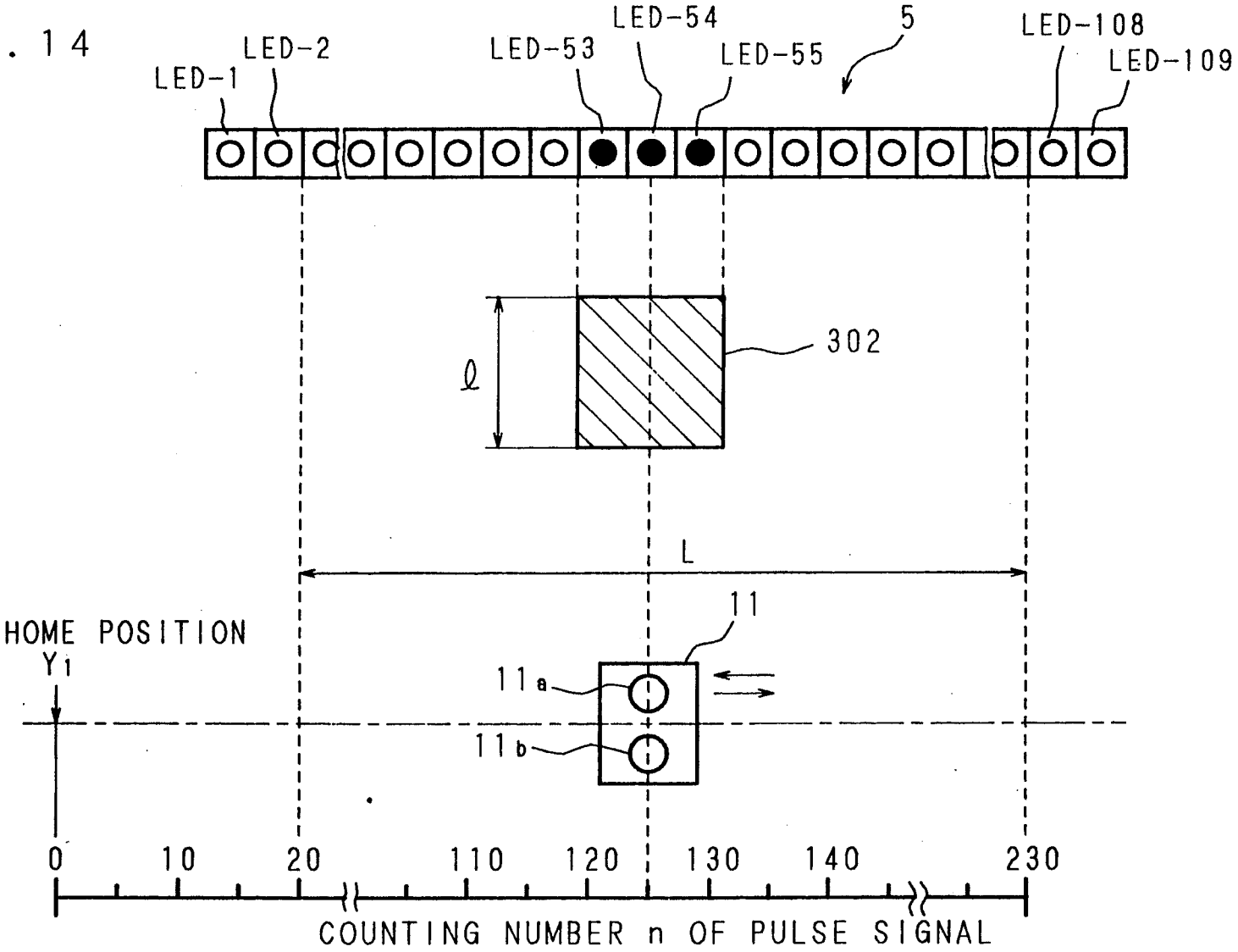
FIG. 14 is a diagram showing the relation among the toner image used in adjusting the quantity of exposure light, an intermediate eraser and a density sensor, and FIGS. 15(*a*) and 15(*b*) is a diagram showing the relation between the density of a toner image and a copied image.

In order to adjust the quantity of exposure light in the instant routine, the seal 25 is again exposed thereby to form a half-tone toner image as a test pattern, and the quantity of exposure light is adjusted so that the density of the half-tone test pattern image is lower than the reference value $V_{d0}$. Since the toner image 302 is formed only at the position where the maximum value $V_{dmax}$ is measured as indicated in FIG. 14 by using the result of measurement in the checking routine of the density unevenness, the consumption of toners can be minimized.

Supposing that the density sensor 11 is moved 2 mm every one shot of the pulse signal $P_m$ of the motor 40, and the LEDs of the intermediate eraser 5 are arranged every 4 mm pitch, the number $n_{LX}$ of the LED to be turned off for formation of the toner image 302 can be calculated by the following equation;

$$n_{LX}=2(n_1-20)/4+2$$

When a part of an integer of $n_{LX}$ is $n_{L2}$, and $n_{L1}=n_{L2}-1$ and $n_{L3}=n_{L2}+1$, the LED to be turned off is obtained by LED -$n_{L1}$, LED - $n_{L2}$ and LED -$n_{L3}$. For example, when $n_1=125$, $n_{LX}$ is 54.5, and therefore the LEDs 53, 54 and 55 are turned off to form the toner image 302. This calculating method is stored in the RAM 307.

The numbers of the LEDs, that is, $n_{L1}$, $n_{L2}$ and $n_{L3}$ are calculated and the LEDs with the calculated numbers are selected in Step S504. In Step S506 where the state I=2, the motor 40 is rotated in the normal direction, starting the movement of the density sensor 11 from the home position $Y_1$ in the g direction. In the state I=3, the counting value n is incremented by 1 every time a pulse signal $P_m$ is generated from the pulse generator of the motor 40 (Steps S508 and S509). When the counting number n becomes $n_1$ corresponding to the maximum value $V_{dmax}$ in Step S510, the motor 40 is stopped (Step S511).

In the state I=4, the timer $T_1$ is started in preparation for formation of a toner image, and the main motor 210 is driven, the intermediate eraser 5, eraser lamp 10 and exposure lamp 21 are turned on, similar to the checking routine of the density unevenness. Moreover, the electrostatic charger 4 is also turned on to apply a bias developing voltage (Steps S513~S519). At this time, all the LEDs 1~109 of the intermediate eraser 5 are turned on. The power source 204 of the exposure lamp 21 is set to be 90 V by the Exp-STEP No. 1.

In the state I=5 when the timer $T_1$ completes counting, the flow moves to Step S523 where the state I=6, with setting the Exp-STEP No. 2. Accordingly, the power source 204 is raised to 91 V, thereby increasing the quantity of light of the exposure lamp 21. Then, the timer $T_2$ is started and the LED-$n_{L1}$, LED-$n_{L2}$ and LED-$n_{L3}$ of the intermediate eraser 5 selected in Step S504 are turned off (Steps S524 and S525). In Step S527 where the state I=7, it is detected whether the timer $T_2$ completes counting. When the timer $T_2$ completes counting, the timer $T_3$ is started to turn on the LED-$n_{L1}$, LED-$n_{L2}$ and LED-$n_{L3}$ (Steps S528 and S529). Accordingly, all the LEDs of the intermediate eraser 5 are turned on again. As a result of this, an electrostatic latent image having a width of 3 LEDs and a length l is formed on the photosensitive drum 3 at the position confronting to LED-$n_{L1}$, LED-$n_{L2}$ and LED-$n_{L3}$, respectively. When the electrostatic latent image passes the developing area $X_3$, it is developed into the toner image 302 shown in FIG. 14. In the state I=8, it is detected whether counting of the timer $T_3$ is finished in Step S531. When the timer $T_3$ completes counting, the toner image 302 reaches the area $X_5$ confronting to the density sensor 11. The density measured by the density sensor 11 is compared with the reference value $V_{d0}$ in Step S532 to determine whether the measured value, i.e., maximum value $V_{dmax}$ is lower than the reference value $V_{d0}$. If the maximum value $V_{dmax}$ is judged to be higher than the reference value $V_{d0}$, the routine is brought to a succeeding state I=9. On the other hand, when the maximum value $V_{dmax}$ is lower than the reference value $V_{d0}$, the quantity of light from the exposure lamp 21 is adjusted properly, and the routine goes to the state I=31, when each output means is turned off.

In the state I=9, 10 and 11, the Exp-STEP No. is incremented by 1 from 2 to 3, with the same operations processed as in the state I=6~8. More specifically, the exposure lamp 21 is turned on with 92 V at the Exp-STEP No. 3, thereby forming the toner image 302. The maximum density $V_{dmax}$ of the toner image is compared with the reference value $V_{d0}$. IF $V_{dmax}$ is lower than $V_{d0}$, the copying machine is brought to the state I=31. If $V_{dmax}$ is higher than $V_{d0}$, the copying machine is moved to the state I=12. In the similar manner as above, the Exp-STEP No. is sequentially incremented until the maximum density $V_{dmax}$ of the toner image 302 becomes lower than the reference value $V_{d0}$, whereby the quantity of light from the exposure lamp 21 is increased to form the toner image 302, and the density of the toner image 302 is measured (state I=3ne, 3ne+1, 3ne+2 and ne=Exp-STEP No.).

When the maximum value $V_{dmax}$ of the toner image 302 formed when the Exp-STEP No. is set to be the highest 9 is detected to be higher than the reference value $V_{d0}$ in Step S710 in the state I=29, it is impossible to increase the quantity of exposure light of the exposure lamp 21 any more, so the flow moves to the state I=30. In the state I=30, the warning display "Cd-9" is indicated on the operation panel 219 to indicate that the density of the toner image is impossible to correct any more. At the same time, the warning is transmitted to the service station. Then, the flow goes to the state I=31 (Steps S713~S715).

In the state I=31, each output means is turned off. That is, the electrostatic charger 4 is turned off in Step S716, and thereafter, application of the bias developing voltage is stopped, and the exposure lamp 21, eraser lamp 10 and all the LEDs of the intermediate eraser 5 are sequentially turned off (Steps S717~S720). The main motor 210 is stopped thereby to stop the rotation of the photosensitive drum 3 (Step S721). In the state I=32, the motor 40 is rotated in the reverse direction to return the density sensor 11 to the home position $Y_1$ (Steps S723~S725). Then, the state I is set to be 1 in Step S726, whereby adjustment of the quantity of exposure light is completed and the flow is returned to the main routine.

Although the photosensitive drum 3 is kept rotating during the above-described adjustment of the quantity of exposure light, needless to say, the photosensitive drum 3 may be stopped the density of the toner image 302 to measure.

Figure 15A:
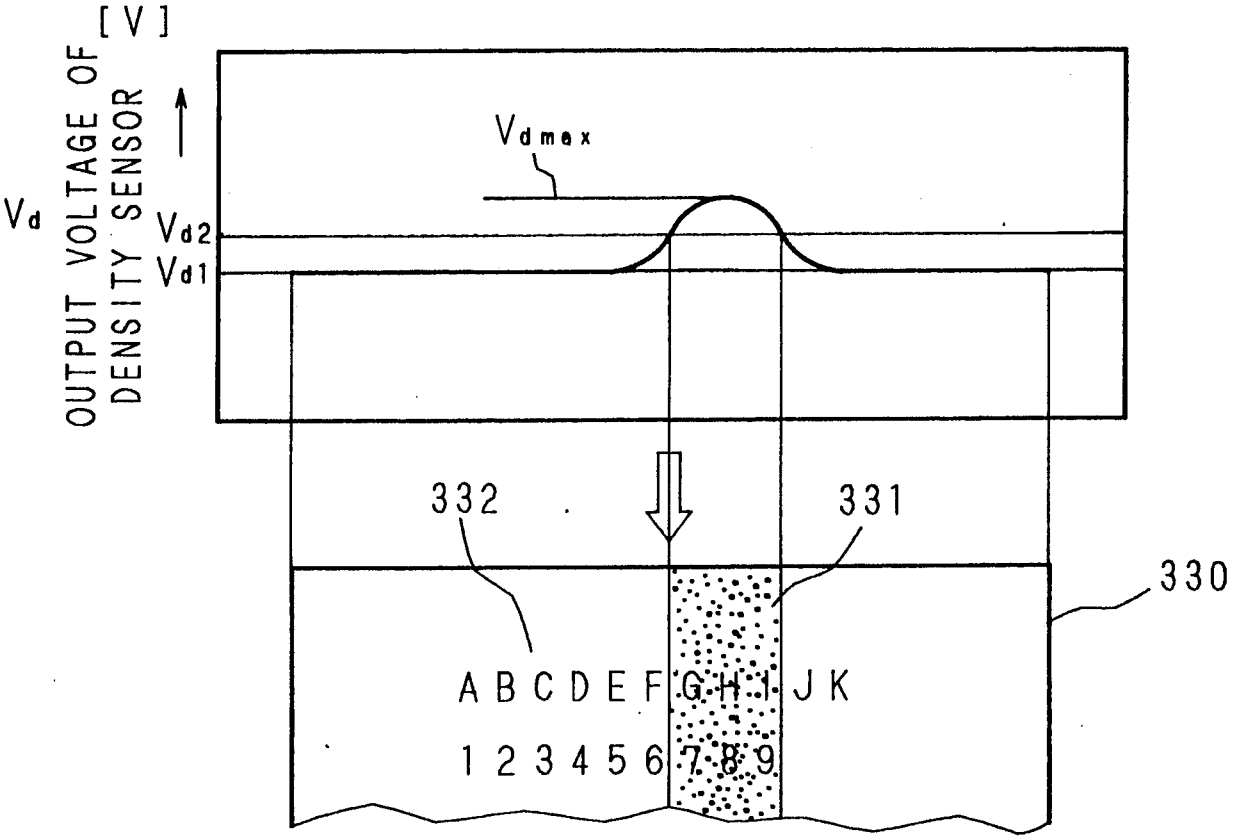
Figure 15B:
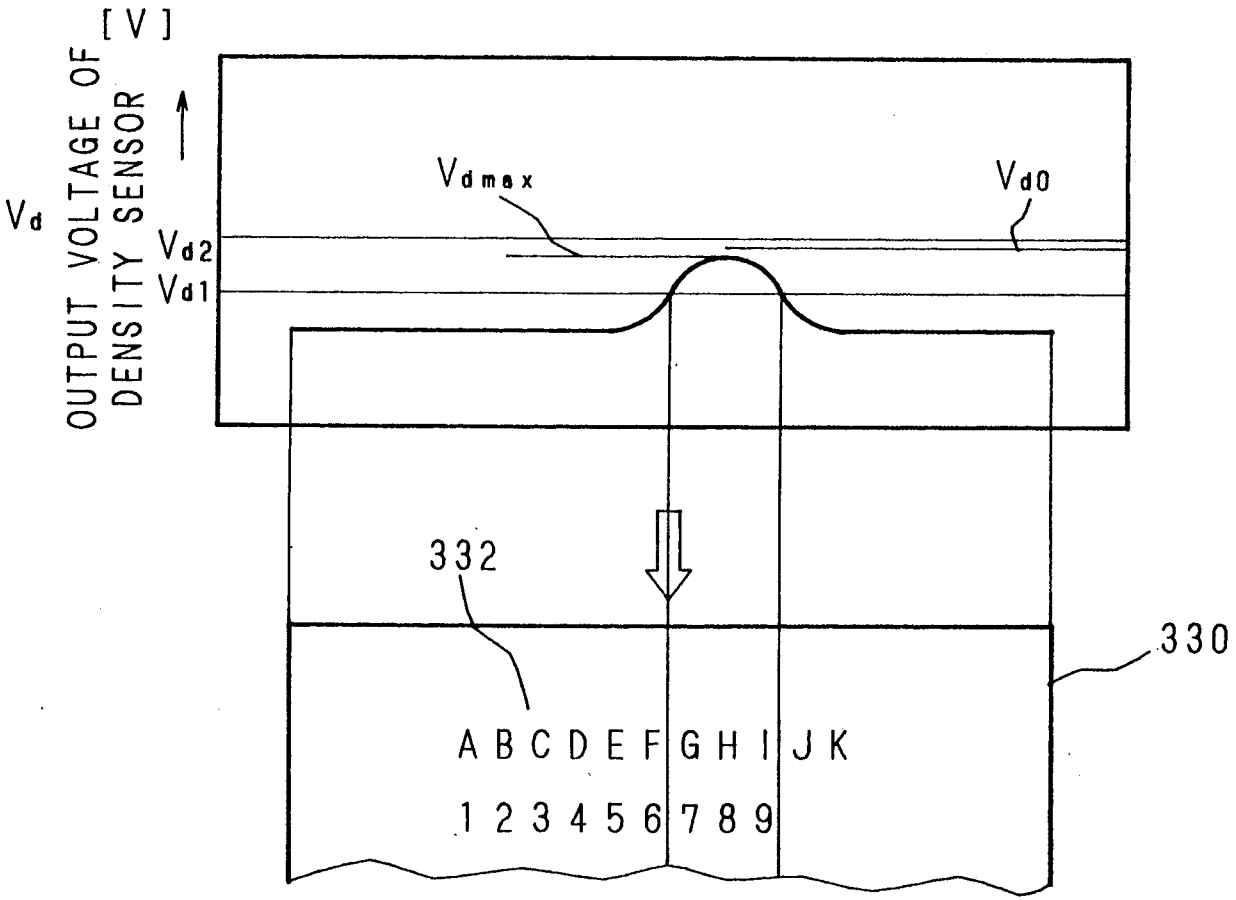

FIG. 15 is a diagram showing the relation of the density of the toner image and the copied image. In FIG. 15(*a*) showing the state when the density unevenness occurs, an axis of ordinate represents the output voltage $V_d$ of the density sensor 11 and an axis of abscissa represents the image forming area L in an elongated direction of the photosensitive drum 3. In this FIG. 15(*a*), the maximum value $V_{dmax}$ results from the fact that the electrostatic charger 4 charges not properly, the electrostatic characteristic of the photosensitive drum 3 is uneven or the optical system 2 performs poor exposure, etc. In other words, the reason for the maximum value $V_{dmax}$ may be considered as that the electrostatic wire 41, electrostatic grid 42 or a stabilizing plate of the electrostatic charger 4 is contaminated, and the exposure lamp 21 of the optical system 2 is deteriorated or dirty, or the mirrors 22*a*~22*d*, lens 23 and the like are not clean. A proper output voltage of the density sensor 11 is $V_{d1}$. When the output voltage exceeds $V_{d2}$, a background fog 331 is brought about on the copying paper 330. Meanwhile, FIG. 15(*b*) shows the state when the quantity of exposure light is adjusted. By increasing the quantity of light of the exposure lamp 21, the maximum value $V_{dmax}$ is arranged to be lower than the reference value $V_{d0}$ set between $V_{d2}$ and $V_{d1}$. Therefore, the background fog 331 due to the density unevenness seen in FIG. 15(*a*) is prevented.

Since the density unevenness itself cannot be corrected by the adjustment above, a copy of the half-tone image is not free from the density unevenness. However, an characters image 332 has constant density, therefore it is scarcely affected by the density unevenness. In case of copying of general documents, therefore, the copying machine encounters with no inconvenience and offers good images.

According to this embodiment, the image density is adjusted by changing the quantity of exposure light, thereby preventing the background fog. However, this invention is not restricted to the above embodiment, and it may be possible to prevent the background fog by adjusting the image density through changing of the charging amount onto the photosensitive drum 3 by the electrostatic charger 4 or changing of the bias developing voltage. More specifically, when a background fog is likely to occur because of the density unevenness, the grid voltage of the electrostatic grid 42 is adjusted so as to reduce the charging amount, or the bias voltage applied to the developing sleeve 61 is increased, whereby the difference between the potential of the latent image and the bias voltage is made smaller. Accordingly, the amount of toners per unit of developing area can be reduced, and the background fog can be prevented by this invention.

The density sensor employed in the present embodiment is constituted such that it measures the density of the toner image while it moves in the image forming area. However, a plurality of density sensors may be arranged all over the image forming area. Furthermore, although a plurality of LEDs of the intermediate eraser 5 are selectively turned on and off to partially form the toner image in the present embodiment, in place of this, a shutter member formed of a plurality of plates or a group of liquid crystal shutters may be intervened in the optical path B corresponding to the elongated direction of the photosensitive drum 3 so as to partially shut the optical path. In addition, the description of the optical system is related to a slit exposure in the foregoing embodiment, but an optical system of a flash exposure is applicable.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An image forming method whereby a toner image is formed on a rotating photosensitive body, comprising:

a step of forming a toner image corresponding to a reference pattern having a predetermined density on said photosensitive body;

a step of measuring the density of said toner image corresponding to said reference pattern at a plurality of points in a direction of a rotary shaft of said photosensitive body; and a step of controlling forming conditions for forming a toner image on said photosensitive body in response to the measured density.

2. An image forming method as set forth in claim 1, wherein said step of forming a toner image on said photosensitive body includes the following steps;

a step of charging said photosensitive body;

a step of forming an electrostatic latent image through exposure of an image of said reference pattern on said photosensitive body; and a step of developing said electrostatic latent image with toners thereby to form the tqner image.

3. An image forming method as set forth in claim 2, wherein said forming condition is the quantity of exposure light when the image of said reference pattern is exposed on said photosensitive body.

4. An image forming method as set forth in claim 2, wherein said forming condition is at least one of the followings;

the charging amount with which said photosensitive body is charged;

the quantity of exposure light when the image of said reference pattern is exposed on said photosensitive body; and the voltage applied to developing means when said electrostatic latent image is developed with toners.

5. An image forming method whereby a toner image is formed on a rotating photosensitive body, comprising:

a step of forming a toner image corresponding to a reference pattern having predetermined density on said photosensitive body;

a step of measuring the density of said toner image corresponding to said reference pattern at a plurality of points in a direction of a rotary shaft of said photosensitive body;

a step of selecting the highest density among the result of measurement of the density of said toner image;

a step of judging whether said highest density is higher than a predetermined density;

a step of controlling forming conditions for forming a toner image on said photosensitive body in response to the measured density; and a step of forming a toner image corresponding to said reference pattern only at point where said highest density is measured when said highest density is higher than said predetermined density.

6. An image forming method whereby a toner image is formed on a rotating photosensitive body, comprising:

a step of forming a toner image corresponding to a reference pattern having a predetermined density on said photosensitive body;

a step of moving measuring means for measuring the density of a toner image on said photosensitive body in a direction of a rotary shaft of said photosensitive body;

a step of measuring the density of said toner image corresponding to said reference pattern at a plurality of points in a direction of the rotary shaft of said photosensitive body by said measuring means; and a step of controlling forming conditions for forming a toner image on said photosensitive body in response to the measured density.

7. An image forming method whereby a toner image is formed on a rotating photosensitive body, comprising:

a step of forming a toner image corresponding to a reference pattern having a predetermined density at an optional point in a direction of a rotary shaft of said photosensitive body;

a step of measuring the density of said toner image corresponding to said reference pattern by measuring means and moving the measuring means to a position corresponding to where said reference pattern is formed; and a step of controlling forming conditions for forming a toner image on said photosensitive body in response to the measured density.

8. An image forming apparatus, comprising:

a rotatable photosensitive body;

image forming means for forming an image on said photosensitive body;

reference pattern forming means for forming an image corresponding to a reference pattern having a predetermined density on said photosensitive body with the use of said image forming means;

measuring means for measuring the density of said image formed by said reference pattern forming means said measuring means being movable in a direction of a rotary shaft of said photosensitive body; and controlling means for controlling forming conditions for said image forming means in response to the density measured by said measuring means.

9. An image forming apparatus as set forth in claim 8, wherein said reference pattern forming means forms the image corresponding to said reference pattern all over said photosensitive body in a direction of a rotary shaft of said photosensitive body.

10. An image forming apparatus as set forth in claim 8, wherein said image forming means includes:

charging means for charging said photosensitive body;

exposure means for exposing an image of a document on said photosensitive body thereby to form an electrostatic latent image; and developing means for developing said electrostatic latent image with toners thereby to form a toner image.

11. An image forming apparatus as set forth in claim 10, wherein said controlling means controls the quantity of exposure light of said exposure means.

12. An image forming apparatus as set forth in claim 10, wherein said controlling means controls at least one of the followings:

the charging amount with which said charging means charges said photosensitive body;

the quantity of exposure light from said exposure means; and the voltage applied to said developing means.

13. An image forming apparatus, comprising:

a rotatable photosensitive body;

image forming means for forming an image through exposure of an image of a document on said photosensitive body;

reference pattern forming means for forming a reference pattern at an optional point of said photosensitive body;

measuring means for measuring the density of said reference pattern, said measuring means being movable corresponding to a position where said reference pattern is formed; and controlling means for controlling forming conditions for said image forming means in response to the density measured by said measuring means.

14. An image forming apparatus, comprising:

a rotatable photosensitive body;

a reference plate having a predetermined density;

charging means for charging said photosensitive body;

illuminating means for illuminating said reference plate;

latent image forming means for forming an electrostatic latent image corresponding to said reference plate on said photosensitive body by guiding a reflecting light from said illuminated reference plate to said charged photosensitive body;

developing means for developing said electrostatic latent image with toners thereby to form a toner image;

measuring means for measuring the density of said toner image at a plurality of points in a direction of a rotary shaft of said photosensitive body;

judging means for judging whether the density measured by said measuring means is higher than a predetermined density; and controlling means for controlling at least one of said charging means, illuminating means and developing means so that the density of a toner image to be formed is lowered when the density measured by said measuring means is higher than the predetermined density.

15. An image forming apparatus as set forth in claim 14, wherein said reference plate is approximately equal in length to said photosensitive body in a direction of the rotary shaft thereof.

16. An image forming apparatus as set forth in claim 15, further comprising forming means for forming a toner image of only a part of said reference plate having higher density than the predetermined density.

17. An image forming apparatus as set forth in claim 16, wherein said forming means has erasing means for partially erasing an electrostatic latent image.

18. An image forming apparatus, comprising:

a rotatable photosensitive body;

image forming means for forming a toner image on said photosensitive body;

reference pattern forming means for forming a toner image corresponding to a reference pattern having a predetermined density on said photosensitive body with the use of said image forming means;

measuring means for measuring the density of said toner image formed by said reference pattern forming means;

controlling means for controlling forming conditions for said image forming means in response to the density measured by said measuring means; and changing means for optionally changing a position where said toner image is formed by said reference pattern forming means, in a direction of a rotary shaft of said photosensitive body.

19. An image forming apparatus as set forth in claim 18, further comprising moving means for moving said measuring means in a direction of the rotary shaft of said photosensitive body corresponding to a forming position of said toner image which is changed by said changing means.

20. An image forming apparatus for forming a toner image on a photosensitive body includes a controller for controlling image forming conditions, the controller executing;

a step of forming a reference toner image on said photosensitive body;

a step of detecting the density of said reference toner image at plural points along a direction of a rotary shaft of said photosensitive body;

a step of judging whether each of said plural detected density values is within a predetermined range; and a step of changing said image forming conditions for forming said toner image on said photosensitive body when at least one of said density values is out of said predetermined range as a result of said judgment.

* * * * *